United States Patent [19]

Caparoni et al.

[11] Patent Number: 5,059,949

[45] Date of Patent: Oct. 22, 1991

[54] CURRENCY ALARM PACK

[75] Inventors: Louis J. Caparoni, Audubon; Robert H. Banfield, Philadelphia; Neal B. Cohen, Flourtown; Homer W. Fogle, Jr., Wallingford, all of Pa.; Michael J. McCann, Wilmington, Del.

[73] Assignee: ICI Americas Inc., Wilmington, Del.

[21] Appl. No.: 521,665

[22] Filed: May 10, 1990

[51] Int. Cl.[5] ..... G08B 13/14; B42D 15/00

[52] U.S. Cl. ..... 340/571; 109/38; 283/83

[58] Field of Search ..... 340/571, 568, 572; 109/29, 31, 38; 283/83

[56] References Cited

U.S. PATENT DOCUMENTS

| | | | |
|---|---|---|---|
| 2,041,577 | 5/1936 | Sutherland | 340/571 X |
| 3,564,525 | 2/1971 | Robeson et al. | 340/571 X |
| 3,828,341 | 8/1974 | Carter, Jr. et al. | 340/571 |

FOREIGN PATENT DOCUMENTS

| | | | |
|---|---|---|---|
| 0661811 | 8/1987 | Switzerland | 340/571 |

*Primary Examiner*—Glen R. Swann, III
*Assistant Examiner*—Thomas J. Mullen, Jr.
*Attorney, Agent, or Firm*—Howson & Howson

[57] ABSTRACT

In a currency alarm pack, greater flexibility is achieved by multiple circuit boards and an alarm device, connected together by a thin, flexible substrate having printed conductors. The components are movable relative to one another for realistic flexure of the stack. At least two of the components are slidable relative to the stack along its direction of elongation as the stack is flexed. Portions of the substrate have tabs which extend laterally between opposed peripheral portions of adjacent intermediate sheets of the currency pack so that the alarm components are supported and can slide longitudinally as the stack is flexed. Adjacent components are connected by narrow portions of the substrate, which permit torsion of the stack. These narrow portions extend transverse to the surfaces of the currency sheets to allow the alarm components a high degree of relative movement. Compressible foam pads conceal the presence of the alarm components. The intermediate sheets of the pack are stitched together loosely by threads to permit shear motion of the pack while maintaining its integrity. The threads have loops extending laterally across the outermost intermediate sheets to hold flexible covers removably. In another version, each opening of the central cavity is covered by two flexible flaps pivoted near the ends of the alarm packs.

27 Claims, 3 Drawing Sheets

CURRENCY ALARM PACK

BRIEF SUMMARY OF THE INVENTION

This invention relates to currency alarm packs, and in particular to an improved currency alarm pack which more closely simulates a pack of currency of the kind kept in a teller's drawer in a bank.

Currency alarm packs are packs which have the appearance of ordinary currency, but which have concealed in them alarm devices which release dye, smoke, and/or tear gas, or which produce other audible or visible alarms to facilitate detection of theft and apprehension of the perpetrator. In the case of a bank robbery, for example, the teller may include an alarm pack among packs of currency delivered to the robber. A timer in the alarm pack triggers an ignition at the end of a predetermined delay, causing the release of tear gas, smoke, an airborne dye suspension, or a combination thereof. The dye suspension makes the stolen currency identifiable, and may also come into contact with the robber or the robber's clothing, thereby making the robber easy to identify.

One form of currency alarm pack for thwarting bank robbers is described in U.S. Pat. No. 3,828,341, issued on Aug. 6, 1974 to C. H. Carter and S. M. Newfeld. The timer in the alarm pack of the Carter and Newfeld patent is activated by a localized electromagnetic field generated adjacent to the exit of the bank. For the alarm to be triggered, the alarm pack must first be taken into the field and then moved out of the field. When the alarm pack is moved out of the field, the timer is activated, and at the end of the timing interval the alarm is triggered. With the proliferation of automatic teller machines (ATMs), similar alarm packs suitable for placement in the currency supply in such machines have been developed.

The principal difficulty encountered in the use of currency alarms is the fact that alarm packs heretofore available, while having the visual appearance of real currency packs, have not had the same "feel". Some bank robbers are able to detect a currency alarm pack because of its stiffness, its comparatively hard tactile feel, the inability of its individual bills to slide relative to one another, or its "riffle" properties, even under the stress and haste of a bank robbery. The robber, upon discerning that he has in hand a device intended to foil his crime, will either refuse to take it, or throw it back.

The principal object of this invention is to provide an improved alarm pack which closely resembles a currency pack, particularly in its feel, thereby reducing the likelihood that a thief will be able to distinguish it from a real currency pack. It is also an object of the invention to provide an alarm pack having more realistic tactile properties, such as the following properties, or combinations thereof: texture, lateral flexibility, torsional flexibility, shear motion, and riffle properties. Still another object of the invention is to provide for easy access to the internal components of the alarm pack, for inspection or battery replacement, for example.

In accordance with this invention an alarm pack is provided comprising an elongated stack of sheets of paper including at least one top sheet, at least one bottom sheet, and a group of intermediate sheets between the top and bottom sheet. The intermediate group of sheets has a hollowed-out central portion providing a space within the stack for alarm components. The top and bottom sheets have the appearance of conventional banknotes, and are preferably genuine banknotes. The peripheries of the sheets of the intermediate group have the appearance of the peripheries of conventional banknotes. The sheets of the intermediate group can also be genuine banknotes with their central portions cut out. A set of alarm components is arranged, within the hollowed-out space, in a series extending in the direction of elongation of the stack. The set of alarm components includes one or more circuit boards carrying electronic means for activating an alarm device, and one or more alarm devices separate from the circuit boards. Flexible means are provided for making electrical interconnections between the circuit boards and the alarm device. The circuit boards and alarm device are movable relative to one another to allow bending of the stack about at least one axis transverse to the direction of elongation of the stack and parallel to the surfaces of the sheets of paper in the stack, and also to allow torsional flexure of the stack about a longitudinal axis. Preferably, the alarm components are slidable relative to the stack along its direction of elongation as the stack is flexed.

In the preferred embodiment of the invention, compressible foam pads are provided above and below the alarm components to conceal their presence. Electrical connections between alarm components are made through a thin, flexible substrate having multiple printed conductors. Portions of the substrate secured to alarm components have tabs which extend laterally between opposed peripheral portions of adjacent sheets of the intermediate group, so that the alarm components are supported by the intermediate sheets of the stack, but allowed to slide as the stack is flexed. Adjacent alarm components are connected by narrow portions of the thin, flexible substrate, which permit torsion of the stack as well as flexing about the transverse axis. These narrow portions may extend transverse to the surfaces of the sheets to allow the components a greater degree of relative movement. The intermediate sheets are held together loosely by threads, pins, rivets, plastic staples, or the like, to permit shear motion of the stack while maintaining its integrity. If threads are used, the threads may have loops extending laterally across the outermost intermediate sheets to hold flexible covers in place while permitting the covers to be removed easily for access to alarm components, and permitting the covers to slide during flexure of the stack. An alternative form of access cover, which gives the alarm pack greater flexibility, comprises two independent flaps pivoted near the ends of the alarm pack.

DETAILED DESCRIPTION

Figure 1:
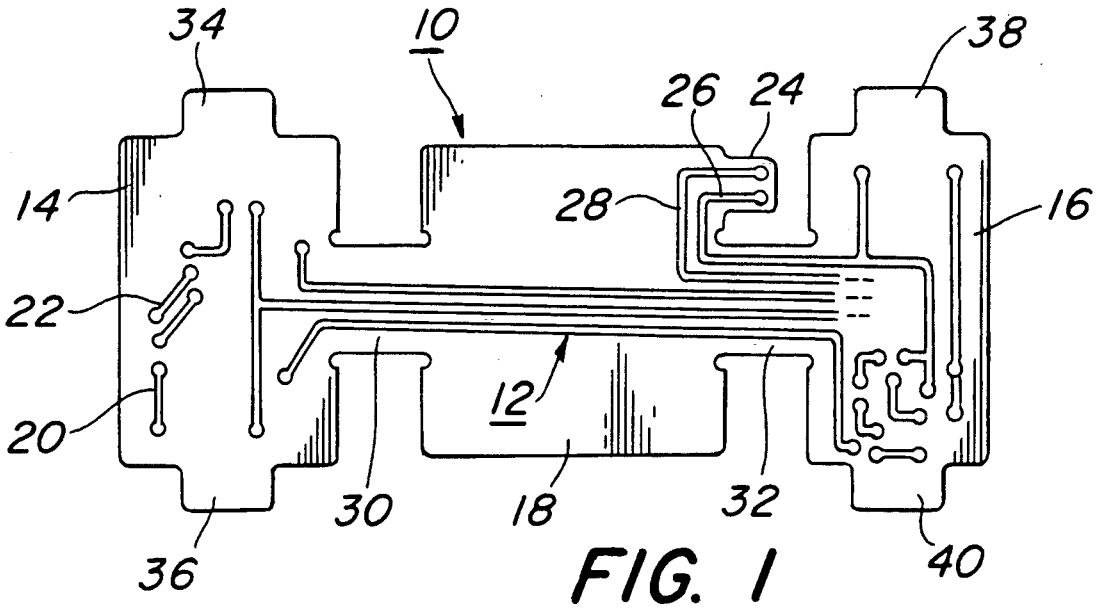
FIG. 1 is a plan view of illustrating the shape of a thin flexible substrate used to conduct electrical power and signals between components of the alarm pack.

The alarm components, in the embodiment to be described, consist of three principal sections: a receiver for detecting an electromagnetic field such as the field continuously generated by a transmitter at the exit of a bank; an alarm device comprising a smoke generator designed to produce an airborne dye suspension for calling attention to the robber and for dyeing, and thereby identifying, the stolen money as well as the robber and his clothing; and a power supply and logic section, including a battery as well as power supply and logic circuitry. These alarm components are interconnected by a thin flexible substrate 10, as shown in FIG. 1, on which are printed various conductors such as conductors 12, which carry operating power and signals between sections 14 and 16 of the substrate.

The substrate is preferably a film of polyester or similar material capable of withstanding a substantial amount of twisting and bending without being damaged. It is formed in three sections, section 14 being associated with the receiver circuitry, section 16 being associated with the battery, power supply and logic circuitry, and the middle section 18 being associated with the alarm device. Sections 14 includes printed conductors, for example, conductors 20 and 22, for interconnecting various components of the receiver circuit. Section 16 has similar printed conductors. Section 18 includes a tab 24 adapted to be bent downward over the edge of an alarm device so that electrical connections can be made from section 16 to terminals located on the side of the alarm device through conductors 26 and 28.

The substrate is notched so that the principal sections 14, 16 and 18 are connected by relatively narrow strips 30 and 32. Strip 32 is sufficiently wide to accommodate conductors 12 as well as conductors 26 and 28. Strip 30 is sufficiently wide to accommodate conductors 12. However both strips are narrow enough that they impose little resistance to relative twisting of sections 14, 16 and 18, even when adjacent sections are situated in separate planes, and the strips 30 and 32 extend in directions transverse to those planes, as will be the case when the apparatus is fully assembled.

Tabs 34 and 36 extend laterally from the side edges of section 14, and tabs 38 and 40 extend in a similar manner from the side edges of section 16. These four tabs project between opposed surfaces of hollowed-out sheets making up the alarm pack to provide support for the receiver section and the power supply/logic section, while allowing the sections to slide relative to the sheets making up the alarm pack as the pack is flexed or twisted.

Figure 2:
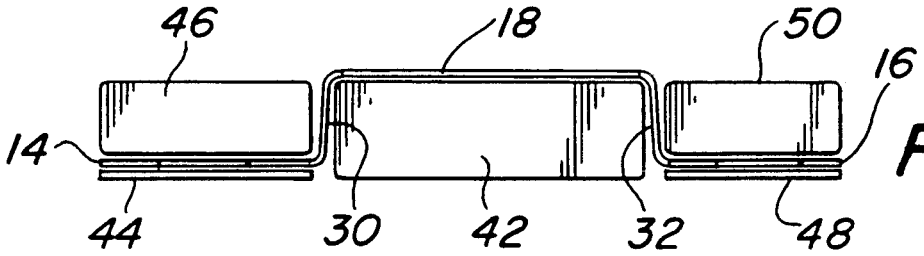
FIG. 2 is a side elevation showing a receiver board, an alarm device, and a power board, and illustrating the configuration of the flexible substrate when connected to the boards and alarm device.

The configuration of the substrate 10 in a fully assembled apparatus is shown in FIG. 2, in which section 18 of the substrate is situated in a plane extending over the top surface of an alarm device 42, sections 14 is situated in a lower plane between a rigid board 44 and a receiver component cover 46, and section 16 is also situated in a lower plane on a rigid board 48, with an electronic component cover 50 covering part of section 16 and a battery cover 52 (FIG. 3) covering another part of section 16. Rigid boards 44 and 48 provide support for the electronic components on sections 14 and 16, and can optionally have printed conductors providing connections between various electronic components where connections are not made by conductors printed on substrate 10. As shown in FIG. 2, narrow strip 30, which connects sections 14 and 18, extends vertically, or nearly vertically, between receiver component cover 48 and alarm device 42. Strip 32 similarly extends vertically, or nearly vertically, between alarm device 42 on one side and covers 50 and 52 on the other side.

Because adjacent sections of the substrate are in separate planes, and are interconnected by strips 30 and 32 extending transverse to those planes, the substrate sections have considerable freedom to slide relative to one another in the longitudinal direction. Furthermore, with the interconnecting strips extending transversely, there is no well-defined pivot axis between the adjacent components. The freedom of the sections to slide relative to one another, and the absence of a well-defined pivot axis, impart realistic flexural characteristics to the alarm pack.

Figure 3:
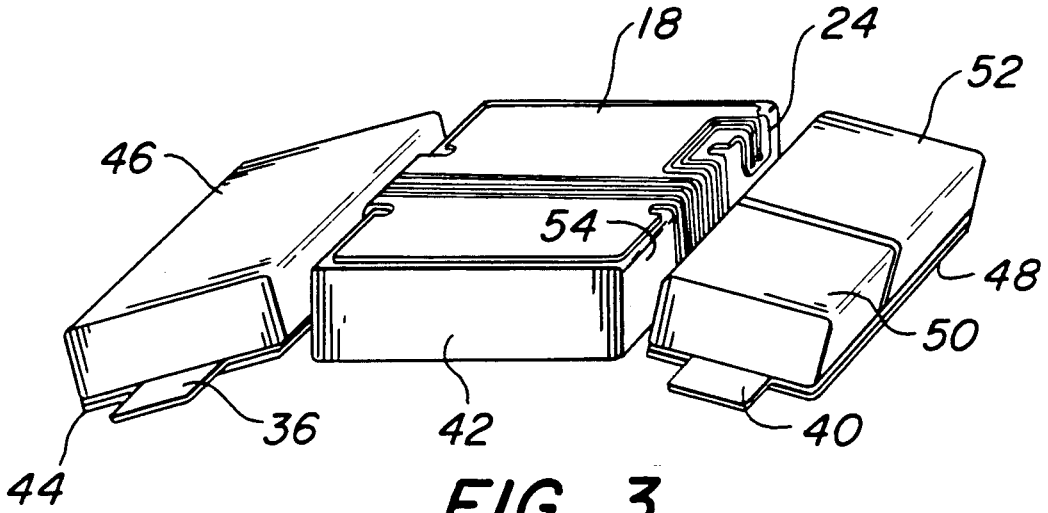
FIG. 3 is a perspective view of the components of FIG. 2, shown in a flexed condition.

FIG. 3 shows the three principal alarm components with the outer components bent downward. The outer components can, of course bend upward in a similar manner, and it is also possible for one of the outer components to bend downward while the other bends upward.

Figure 4:
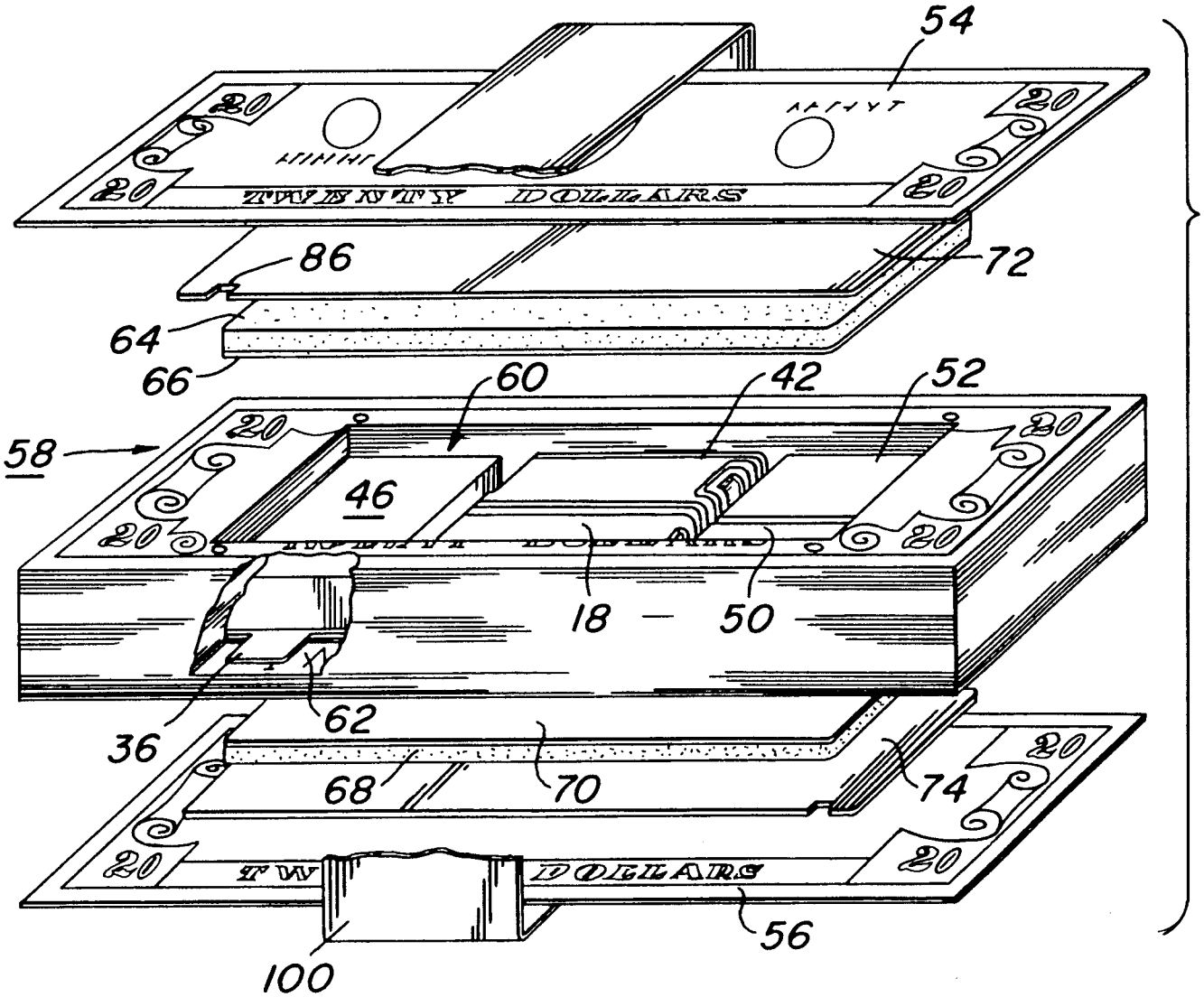
FIG. 4 is an exploded perspective view showing the principal components of the alarm pack and their relationship.

The alarm pack, as shown in exploded view in FIG. 4, comprises a top sheet 54, which will ordinarily be a genuine banknote, e.g. a twenty dollar bill, and a similar bottom sheet 56. In a practical alarm pack, there may be several top sheets corresponding to sheet 54, as well as several bottom sheets corresponding to sheet 56. Between the top and bottom sheets is a stack 58, also preferably of genuine banknotes, hollowed out to provide an elongated, rectangular interior space 60 to accommodate the alarm components. As shown in FIG. 4, tab 36 of substrate section 14 (see FIGS. 1 and 3) extends outward over the peripheral surface 62 of one of the sheets in stack 58 and is situated immediately underneath the peripheral surface of the next adjacent sheet. The remaining three tabs 34, 38 and 40, similarly project between adjacent sheets of stack 58, preferably the same pair of sheets between which tab 36 projects. By engaging the sheets of stack 58 in this manner, the tabs support the alarm components from which they extend while allowing the components to slide longitudinally relative to each other and relative to stack 58 as the stack is flexed. The tabs also allow the alarm components to slide both longitudinally and from side to side as the stack is twisted. Supporting alarm components in this manner prevents binding of the components, which will often result in unnatural flexural characteristics.

A pad 64 of compressible synthetic foam rubber or the like is arranged within space 60, and has a friction-reducing smooth sheet 66 of paper or the like secured to its underside to facilitate sliding of the alarm components relative to the pad. The length and width of the pad are preferably only slightly less than the length and width of space 60, and its thickness is such that the upper surface of the pad is flush with the uppermost sheet of stack 58 when sheet 66 is in contact with the alarm components within space 60. A similar pad 68, having a smooth sheet 70 on its upper side, is positioned in space 60 underneath the alarm components. The compressible pads give the alarm pack a soft feel, and prevent the bank robber from perceiving the hardness of the alarm components.

Figure 5:
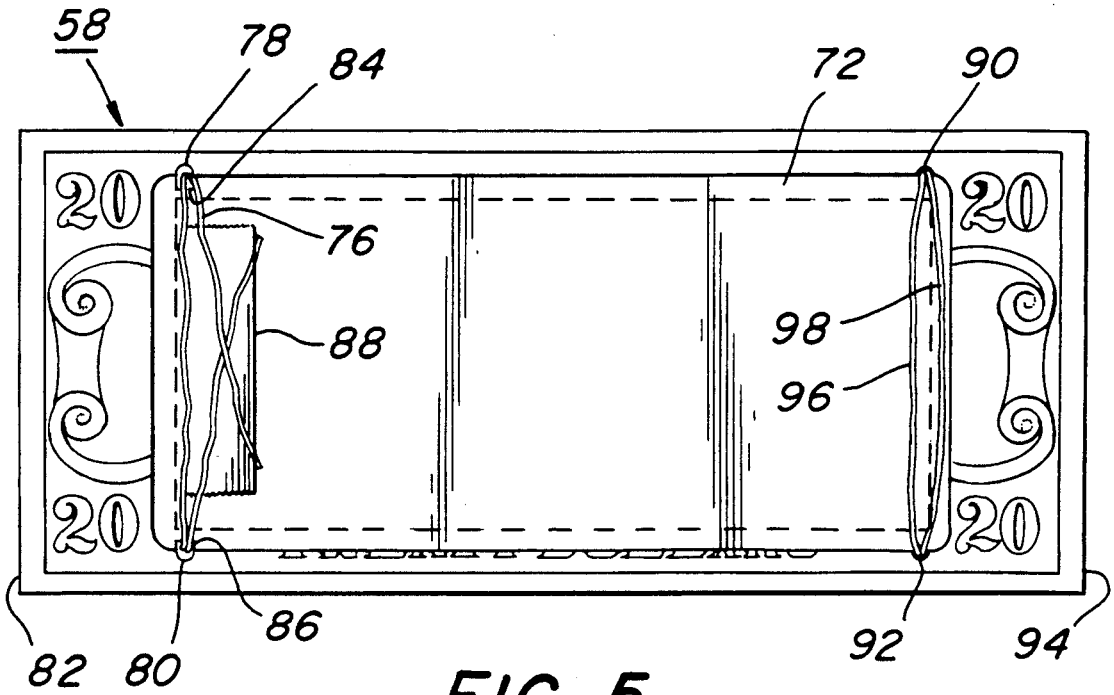
FIG. 5 is a top plan view of the stack of sheets in the alarm pack, with the top sheet removed to show the flexible cover and threads by which the intermediate sheets are stitched together.

Directly above pad 64, there is provided a thin, flexible cover sheet 72, of polyester or similar material. This cover sheet completely covers the opening in the top sheet of stack 58, and extends a short distance beyond the edges of the opening, as shown in FIG. 5, to overlie the peripheral edges of the top sheet of the stack. A similar sheet 74 is provided underneath pad 68. Sheets 72 and 74 are held in place by threads stitched through the sheets of stack 58, but can be easily removed from the openings of space 60 to provide access to the alarm components.

Referring to FIG. 5, a first thread 76 is looped twice through holes 78 and 80 which extend through stack 58 at locations near the corners of the interior space 60. Holes 78 and 80 are equally spaced from the left end 82 of stack 58. Notches 84 and 86 are provided in cover sheet 72 to receive thread 76 and thereby limit longitudinal sliding movement of the cover sheet. The free ends of thread 76 are secured to the cover sheet by a tape 88. A similar thread is looped through holes 90 and 92 near the opposite end 94 of stack 58, with its free ends (not shown) taped to bottom cover sheet 74. The right hand end of top cover sheet 72 extends underneath loops 96 and 98, and is held thereby against the top sheet of stack 58. Similar loops (not shown) of thread 76 hold the left end of bottom cover sheet 74 against the bottom of stack 58. The cover sheets can be easily slipped out from underneath the loops of thread, and opened as flaps, to expose pads 64 and 68 (FIG. 4), which can then be removed for access to the alarm components.

The threads are not pulled tight, but rather are taped to the top and bottom sheets in such a way that they are slightly loose. This allows longitudinal sliding of the sheets of stack 58 relative to one another, as well as longitudinal sliding of cover sheets 72 and 74 relative to the stack. The ability of the sheets of stack 52 and the cover sheets to slide gives the alarm pack a realistic feel when flexed, twisted or riffled.

A paper band 100, shown in FIG. 4 surrounds the alarm pack, and serves to prevent the sheets of the alarm pack, including the hollowed-out sheets of stack 58, from separating from one another at intermediate locations along the length of the alarm pack.

Figure 6:
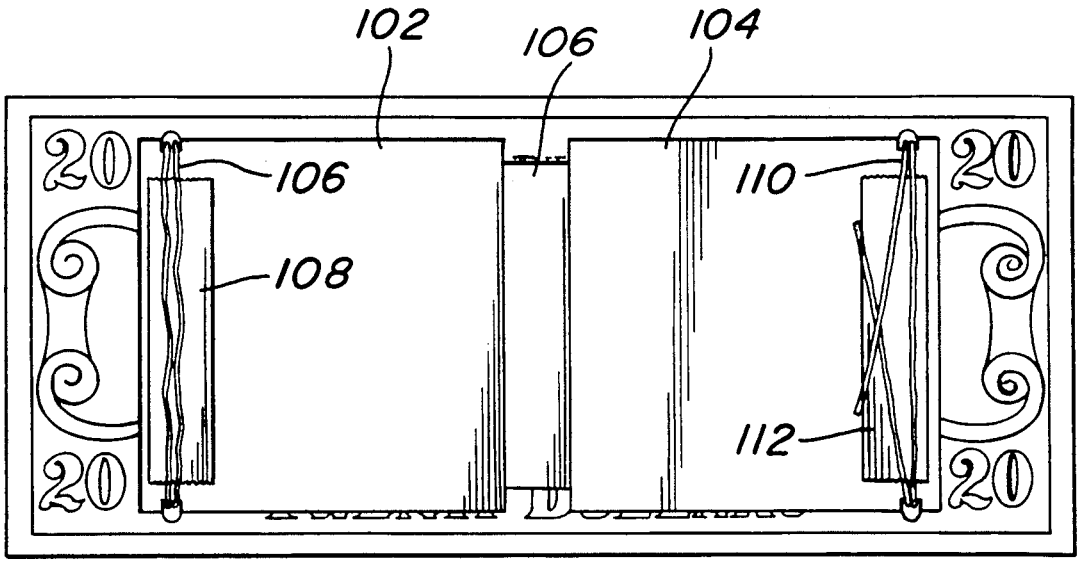
FIG. 6 is a top plan view, similar to FIG. 5, showing a modified form of flexible cover.

In the version of the alarm pack shown in FIG. 6, the flexible cover, corresponding to cover 72 in FIGS. 4 and 5, is divided into two separate parts 102 and 104, each permanently attached to one of the threads which holds the intermediate sheets together. Part 102 is secured to thread 106 by tape 108, and part 104 is similarly secured to thread 110 by tape 112. The two parts of the flexible cover serve as flaps which are pivotally connected by the threads to the stack of intermediate sheets near its ends. When the paper band of the alarm pack is removed, these flaps can be opened up at the center of the pack to allow removal of pad 106 for exposure of the alarm components. The flexible cover (not shown) on the opposite side of the alarm pack may be similarly constructed of two separate parts. An advantage of the two part flexible cover is that it provides the alarm pack with increased torsional and lateral flexibility.

The features of the invention described above all contribute to the realistic feel of the alarm pack. The articulation and relative longitudinal sliding of the alarm components allows the thief to flex the alarm pack to a substantial degree without perceiving that it is anything other than a real currency pack. The support of the circuit boards by tabs extending slidably between the surfaces of hollowed-out bills, the narrow connecting strips between sections of the flexible printed circuit substrate, and the stitching of the sheets together loosely by threads, all contribute to the realistic feel of the alarm pack.

Many modifications can be made to the alarm pack as described above. For example, the intermediate section 18 of the flexible circuit substrate 10 can be provided with tabs corresponding to tabs 34–40. Fasteners such as pins, rivets, elastic threads or plastic staples can be used in place of the threads shown in FIG. 5. The alarm components, can consist of only two segments, or can be further divided into additional segments including, for example, two or more alarm devices such as smoke generators, tear gas-releasing devices and the like. These devices may be simultaneously triggered, or triggered in a predetermined sequence at different times. Furthermore, the alarm components can be arranged in an order different from the order described. Various other modifications, which will occur to persons skilled in the art, may be made without departing from the scope of the invention as defined in the following claims.

We claim:

1. An alarm pack comprising:

an elongated stack of sheets of paper including at least one top sheet, at least one bottom sheet, and a group of intermediate sheets between the top and bottom sheet, the group of intermediate sheets having a hollowed-out central portion providing a space within the stack for alarm components, the top and bottom sheets having the appearance of conventional banknotes, and the peripheries of the intermediate sheets of the stack having the appearance of the peripheries of conventional banknotes;

means for holding said top, bottom and intermediate sheets together in the stack while allowing flexure of the stack about at least one axis which is transverse to the direction of elongation of the stack and parallel to the surfaces of the sheets of paper in the stack, and which intersects said hollowed-out central portion;

a set of alarm components arranged within said space in a series extending in the direction of elongation of the stack; and flexible means providing electrical interconnections between the alarm components;

said alarm components being movable relative to one another to allow flexure of the stack about said transverse axis.

2. An alarm pack according to claim 1 having a compressible pad located bet ween one of the top and bottom sheets and said set of alarm components, said pad having an inner surface facing said alarm components and an outer surface substantially in register with the intermediate sheet adjacent to said one of the top and bottom sheets, said outer surface having a shape substantially conforming to the shape of said hollowed-out central portion.

3. An alarm pack according to claim 1 in which the flexible means providing electrical interconnections between the alarm components is a flexible, thin substrate having multiple conductors printed thereon, said substrate extending from one alarm component to an adjacent alarm component, and said substrate having a wide portion secured to said one alarm component and a narrower portion extending between said one alarm component and said adjacent alarm component.

4. An alarm pack according to claim 1 in which the intermediate sheets of the stack have first and second sets of aligned perforations providing a pair of through holes, each extending substantially perpendicular to the surfaces of the sheets from the top intermediate sheet to the bottom intermediate sheet at locations in peripheral areas of said intermediate sheets near the respective long edges thereof but substantially equally spaced from one of the short edges thereof, and having means extending through both of said through holes for securing said intermediate sheets together near said one of the short edges while allowing riffling of the intermediate sheets in the vicinity of said one of the short edges and allowing limited relative sliding movement of said intermediate sheets.

5. An alarm pack according to claim 1 in which the intermediate sheets of the stack have first and second sets of aligned perforations providing a pair of through holes, each extending substantially perpendicular to the surfaces of the sheets from the top intermediate sheet to the bottom intermediate sheet at locations in peripheral areas of said intermediate sheets near the respective long edges thereof but substantially equally spaced from one of the short edges thereof, said alarm pack having thread means extending through both of said through holes for securing said intermediate sheets together near said one of the short edges while allowing riffling of the intermediate sheets in the vicinity of said one of the short edges and allowing limited relative sliding movement of said intermediate sheets, said thread means having a loop extending across one of the top-most and bottom-most intermediate sheets from one of said through holes to the other, and said alarm pack having a first flexible cover overlying the hollowed-out central portion of the topmost intermediate sheet, and a second flexible cover underlying the hollowed-out central portion of the bottom-most intermediate sheet, said thread means being secured to one of said flexible covers, and the other flexible cover extending slidably between said loop of the thread means and the intermediate sheet across which said loop extends, whereby said other flexible cover can be removed to expose the alarm components within the stack by sliding it out of said loop.

6. An alarm pack according to claim 1 in which the intermediate sheets of the stack have first and second sets of aligned perforations providing a first pair of through holes, each extending substantially perpendicular to the surfaces of the sheets from the top intermediate sheet to the bottom intermediate sheet at locations in peripheral areas of said intermediate sheets near the respective long edges thereof but substantially equally spaced from one of the short edges thereof, third and fourth sets of aligned perforations providing a second pair of through holes, each extending substantially perpendicular to the surfaces of the sheets from the top intermediate sheet to the bottom intermediate sheet at locations in peripheral areas of said intermediate sheets near the respective long edges thereof but substantially equally spaced from the other of the short edges thereof, and having means extending through both of the through holes of each pair for securing said intermediate sheets together near said short edges while allowing riffling of the intermediate sheets in the vicinity of said one of the short edges and allowing limited relative sliding movement of said intermediate sheets.

7. An alarm pack according to claim 1 in which said holding means permits sliding movement of the sheets of said group of intermediate sheets relative to one another along the direction of elongation of the stack.

8. An alarm pack according to claim 1 in which said holding means comprises thread means loosely stitching the sheets of said group of intermediate sheets together and permitting sliding movement of the sheets of said group of intermediate sheets relative to one another along the direction of elongation of the stack.

9. An alarm pack comprising:

an elongated stack of sheets of paper including at least one top sheet, at least one bottom sheet, and a group of intermediate sheets between the top and bottom sheet, the group of intermediate sheets having a hollowed-out central portion providing a space within the stack for alarm components, the top and bottom sheets having the appearance of conventional banknotes, and the peripheries of the intermediate sheets of the stack having the appearance of the peripheries of conventional banknotes;

means for holding said top, bottom and intermediate sheets together in the stack while allowing flexure of the stack about at least one axis which is transverse to the direction of elongation of the stack and parallel to the surfaces of the sheets of paper in the stack, and which intersects said hollowed-out central portion;

a set of alarm components arranged within said space in a series extending in the direction of elongation of the stack, the set of alarm components including at least one circuit board carrying electronic means for activating an alarm device, and an alarm device separate from said circuit board; and flexible means providing electrical interconnections between at least two of said alarm components;

said two alarm components being movable relative to each other to allow flexure of the stack about said transverse axis, and being slidable relative to the stack along said direction of elongation, as the stack is flexed about said transverse axis.

10. An alarm pack according to claim 9 having a compressible pad located between one of the top and bottom sheets and said set of alarm components, said pad having an inner surface facing said alarm components and an outer surface substantially in register with the intermediate sheet adjacent to said one of the top and bottom sheets, said outer surface having a shape substantially conforming to the shape of said hollowed-out central portion.

11. An alarm pack according to claim 9 having a compressible pad of foam material located between one of the top and bottom sheets and said set of alarm components, said pad having an inner surface facing said alarm components and an outer surface substantially in register with the intermediate sheet adjacent to said one of the top and bottom sheets, said outer surface having a shape substantially conforming to the shape of said hollowed-out central portion.

12. An alarm pack according to claim 9 having a compressible pad of foam material located between one of the top and bottom sheets and said set of alarm components, said pad having a smooth inner surface facing said alarm components and allowing free sliding movement of said alarm components along said inner surface, and said pad having an outer surface substantially in register with the intermediate sheet adjacent to said one of the top and bottom sheets, said outer surface having a shape substantially conforming to the shape of said hollowed-out central portion.

13. An alarm pack according to claim 9 in which the flexible means providing electrical interconnections between at least two of said alarm components is a flexible, thin substrate having multiple printed circuit conductors thereon, said substrate having portions secured to both of said two alarm components and the portion of said substrate secured to at least one of the two alarm components having first and second tab means extending laterally in opposite directions, both transverse to the direction of elongation of the stack and parallel to the surfaces of the sheets of paper in the stack, each of said first and second tab means extending between the surfaces of peripheral portions of adjacent sheets of the group of intermediate sheets, and thereby supporting and guiding said one of the two alarm components as it slides relative to the stack along the direction of elongation of the stack as the stack is flexed about said transverse axis.

14. An alarm pack according to claim 9 in which the flexible means providing electrical interconnections between at least two of said alarm components is a flexible, thin substrate having multiple printed circuit conductors thereon, said substrate having a wide portion secured to one of said alarm components and a narrower portion extending from said one of said two alarm components to the other of said two alarm components.

15. An alarm pack according to claim 9 in which the flexible means providing electrical interconnections between at least two of said alarm components is a flexible, thin substrate having multiple printed circuit conductors thereon, said substrate having a wide portion secured to one of the two alarm components and a narrower portion extending from said one of the two alarm components to the other of the two alarm components, said wide portion of the substrate having first and second tab means extending laterally in opposite directions, both transverse to the direction of elongation of the stack and parallel to the surfaces of the sheets of paper in the stack, each of said first and second tab means extending between the surfaces of peripheral portions of adjacent sheets of the group of intermediate sheets, and thereby supporting and guiding said one of the two alarm components as it slides relative to the stack along the direction of elongation of the stack as the stack is flexed about said transverse axis.

16. An alarm pack according to claim 9 in which the flexible means providing electrical interconnections between at least two of said alarm components is a flexible, thin substrate having multiple conductors printed thereon, said substrate having a wide portion secured to one of said alarm components and a narrower portion extending from said one of said alarm components to the other of said alarm components, and in which the wide portion of said substrate secured to said one of said alarm components includes conductor means providing electrical connections between electronic components on said one of said alarm components.

17. An alarm pack according to claim 9 in which the flexible means providing electrical interconnections between at least two of said alarm components is a flexible, thin substrate having multiple printed circuit conductors thereon, said substrate having a wide portions secured to said one of said alarm components and a narrower portion extending from said one of said alarm components to the other of said two alarm components, and the portion of said substrate secured to said one of said alarm components having first and second tab means extending laterally in opposite directions, both transverse to the direction of elongation of the stack and parallel to the surfaces of the sheets of paper in the stack, each of said first and second tab means extending between the surfaces of peripheral portions of adjacent sheets of the group of intermediate sheets, and thereby supporting and guiding said one of said alarm components as it slides relative to the stack along the direction of elongation of the stack as the stack is flexed about said transverse axis, and in which the wide portion of said substrate secured to said one of said alarm components includes conductor means providing electrical connections between electronic components on said one of said alarm components.

18. An alarm pack according to claim 9 in which the flexible means providing electrical interconnections between at least two of said alarm components is a flexible, thin substrate having multiple conductors printed thereon, in which said substrate has a first portion connected to said one of said alarm components and disposed in a first plane substantially parallel to the surfaces of said sheets of paper, in which said substrate includes a second portion connected to the other of said alarm components and situated in a second plane parallel to and spaced from said first plane, and in which said first and second portions of the substrate are connected by a narrow portions of the substrate extending in a direction transverse to said first and second planes.

19. An alarm pack according to claim 9 in which the intermediate sheets of the stack have first and second sets of aligned perforations providing a pair of through holes, each extending substantially perpendicular to the surfaces of the sheets from the top intermediate sheet to the bottom intermediate sheet at locations in peripheral areas of said intermediate sheets near the respective long edges thereof but substantially equally spaced from one of the short edges thereof, and having means extending through both of said through holes for securing said intermediate sheets together near said one of the short edges while allowing riffling of the intermediate sheets in the vicinity of said one of the short edges and allowing limited relative sliding movement of said intermediate sheets.

20. An alarm pack according to claim 9 in which the intermediate sheets of the stack have first and second sets of aligned perforations providing a pair of through holes, each extending substantially perpendicular to the surfaces of the sheets from the top intermediate sheet to the bottom intermediate sheet at locations in peripheral areas of said intermediate sheets near the respective long edges thereof but substantially equally spaced from one of the short edges thereof, said alarm pack having thread means extending through both of said through holes for loosely securing said intermediate sheets together near said one of the short edges, said thread means having a loop extending across one of the topmost and bottom-most intermediate sheets from one of said through holes to the other, and said alarm pack having a first flexible cover overlying the hollowed-out central portion of the topmost intermediate sheet, and a second flexible cover underlying the hollowed-out central portion of the bottom-most intermediate sheet, said thread means being secured to one of said flexible covers, and the other flexible cover extending slidably between said loop of the thread means and the intermediate sheet across which said loop extends, whereby said other flexible cover can be removed to expose the alarm components within the stack by sliding it out of said loop.

21. An alarm pack according to claim 9 in which the intermediate sheets of the stack have first and second sets of aligned perforations providing a first pair of through holes, each extending substantially perpendicular to the surfaces of the sheets from the top intermediate sheet to the bottom intermediate sheet at locations in peripheral areas of said intermediate sheets near the respective long edges thereof but substantially equally spaced from one of the short edges thereof, third and fourth sets of aligned perforations providing a second pair of through holes, each extending substantially perpendicular to the surfaces of the sheets from the top intermediate sheet to the bottom intermediate sheet at locations in peripheral areas of said intermediate sheets near the respective long edges thereof but substantially equally spaced from the other of the short edges thereof, and having means extending through both of the through holes of each pair for securing said intermediate sheets together near said short edges while allowing riffling of the intermediate sheets in the vicinity of said short edges and allowing limited relative sliding movement of said intermediate sheets.

22. An alarm pack according to claim 9 in which the intermediate sheets of the stack have first and second sets of aligned perforations providing a first pair of through holes, each extending substantially perpendicular to the surfaces of the sheets from the top intermediate sheet to the bottom intermediate sheet at locations in peripheral areas of said intermediate sheets near the respective long edges thereof but substantially equally spaced from one of the short edges thereof, third and fourth sets of aligned perforations providing a second pair of through holes, each extending substantially perpendicular to the surfaces of the sheets from the top intermediate sheet to the bottom intermediate sheet at locations in peripheral areas of said intermediate sheets near the respective long edges thereof but substantially equally spaced from the other of the short edges thereof, and having means extending through both of the through holes of each pair for securing said intermediate sheets together near said short edges while allowing riffling of the intermediate sheets in the vicinity of said short edges and allowing limited relative sliding movement of said intermediate sheets, and band means extending around all of the sheets of the stack at an intermediate position between the locations of the first pair of through holes and the second pair of through holes, for preventing separation of the sheets from one another at said intermediate position.

23. An alarm pack according to claim 9 in which areas of the faces of said intermediate sheets extending inwardly from the peripheries thereof and extending substantially all the way around the peripheries of the intermediate sheets, have the appearance of conventional banknotes.

24. An alarm pack according to claim 9 in which the flexible means providing electrical interconnections between at least two of said alarm components is a flexible, thin substrate having multiple printed circuit conductors thereon, said substrate having a wide portion secured to one of said two alarm components and a narrower portion extending from said one of said two alarm components to an the other of said two alarm components, and said wide portion of the substrate having first and second tab means extending laterally in opposite directions, both transverse to the direction of elongation of the stack and parallel to the surfaces of the sheets of paper in the stack, each of said first and second tab means extending between the surfaces of peripheral portions of adjacent sheets of the group of intermediate sheets, and thereby supporting and guiding said one of the alarm components as it slides relative to the stack as the stack is twisted about an axis parallel to its direction of elongation.

25. An alarm pack according to claim 9 having top and bottom cover means for at least partially enclosing said hollowed-out central portion, said top and bottom cover means each comprising a first flap pivotally connected to the intermediate sheets near one end of the alarm pack, and a second flap pivotally connected to the intermediate sheets near the opposite end of the alarm pack, the first and second flaps of each of the top and bottom cover means being independently movable whereby the alarm pack has a high degree of torsional flexibility as well as a high degree of flexibility about said transverse axis.

26. An alarm pack according to claim 9 in which said holding means permits sliding movement of the sheets of said group of intermediate sheets relative to one another along the direction of elongation of the stack.

27. An alarm pack according to claim 9 in which said holding means comprises thread means loosely stitching the sheets of said group of intermediate sheets together and permitting sliding movement of the sheets of said group of intermediate sheets relative to one another along the direction of elongation of the stack.

* * * * *